US005472004A

United States Patent [19]

Gilliard

[11] Patent Number: 5,472,004

[45] Date of Patent: Dec. 5, 1995

[54] SPINEBOARD DECONTAMINATION UNIT

[76] Inventor: Jeffery D. Gilliard, 851 Dove Ave., Rockledge, Fla. 32955

[21] Appl. No.: 335,376

[22] Filed: Nov. 3, 1994

[51] Int. Cl.[6] ..... B08B 3/02

[52] U.S. Cl. ..... 134/111; 134/199; 134/200

[58] Field of Search ..... 134/111, 191, 134/198, 199, 200

[56] References Cited

U.S. PATENT DOCUMENTS

| | | | |
|---|---|---|---|
| 3,511,252 | 5/1970 | Kennedy | 134/199 X |
| 4,295,730 | 10/1981 | Fraser | 134/199 X |
| 4,342,326 | 8/1982 | Meier | 134/199 X |
| 4,646,769 | 3/1987 | O'Brien et al. | 134/199 |
| 4,762,139 | 8/1988 | Timmes et al. | 134/199 |
| 4,971,083 | 11/1990 | Stach et al. | 134/199 X |

*Primary Examiner*—Philip R. Coe

*Attorney, Agent, or Firm*—Finnegan, Henderson, Farabow, Garrett & Dunner

[57] ABSTRACT

Apparatus for cleaning and disinfecting spineboards includes a housing, a rack system for supporting at least one spineboard within the housing, and piping positioned in the housing and including a plurality of nozzles or ports. A tank containing a disinfectant is in flow communication with the piping, and a pump circulates the disinfectant from the tank through the piping and nozzles or ports to impinge the disinfectant against the at least one spineboard.

16 Claims, 5 Drawing Sheets

SPINEBOARD DECONTAMINATION UNIT

BACKGROUND OF THE INVENTION

1. Field of the Invention

The present invention relates generally to a cleaning and disinfecting method and apparatus and, more particularly, to a method and apparatus for cleaning and disinfecting spineboards.

2. Discussion of the Related Art

Spineboards are used by medical personnel, particularly paramedics, to transport injured persons from an accident scene to a hospital when there is a possibility of a spinal injury. The spineboards, which are typically made of plastic or fiberglass, help immobilize the spine during transport to prevent or further aggravate spinal injuries, which can result in paralysis.

Spineboards frequently come into contact with blood and other contaminants during use and, thus, must be thoroughly cleaned and disinfected after each use. Presently, however, such cleaning methods typically consist of personnel standing the spineboards against a wall and manually spraying and scrubbing the spineboards with a disinfectant solution. Such methods are obviously time-consuming and inefficient, and pose serious health risks to the persons manually cleaning the spineboards. In addition, the contaminants washed from the spineboards and the disinfectant solution are typically left to drain into the ground or into sewers, which also poses serious health risks.

SUMMARY OF THE INVENTION

The present invention is directed to a spineboard decontamination unit and method that represents a significant improvement over the prior art and overcomes the limitations and disadvantages of the prior methods to clean spineboards.

Additional features and advantages of the invention will be set forth in the description which follows, and in part will be apparent from the description, or may be learned by practice of the invention. The objectives and other advantages of the invention will be realized and attained by the system particularly pointed out in the written description and claims, as well as the appended drawings.

To achieve these and other advantages and in accordance with the purpose of the invention, as embodied and broadly described herein, an apparatus for cleaning and disinfecting spineboards with a disinfectant includes a housing, at least one rack for supporting at least one spineboard within the housing, a tank for containing the disinfectant, piping positioned in the housing and in flow communication with the tank, the piping including means for impinging the disinfectant against the at least one spineboard, and a pump for circulating the disinfectant from the tank through the piping and impinging means, the pump and the impinging means being sized to impinge the disinfectant against the at least one spineboard with sufficient force and flow to clean and disinfect the entire surface of the spineboard.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Figure 1:
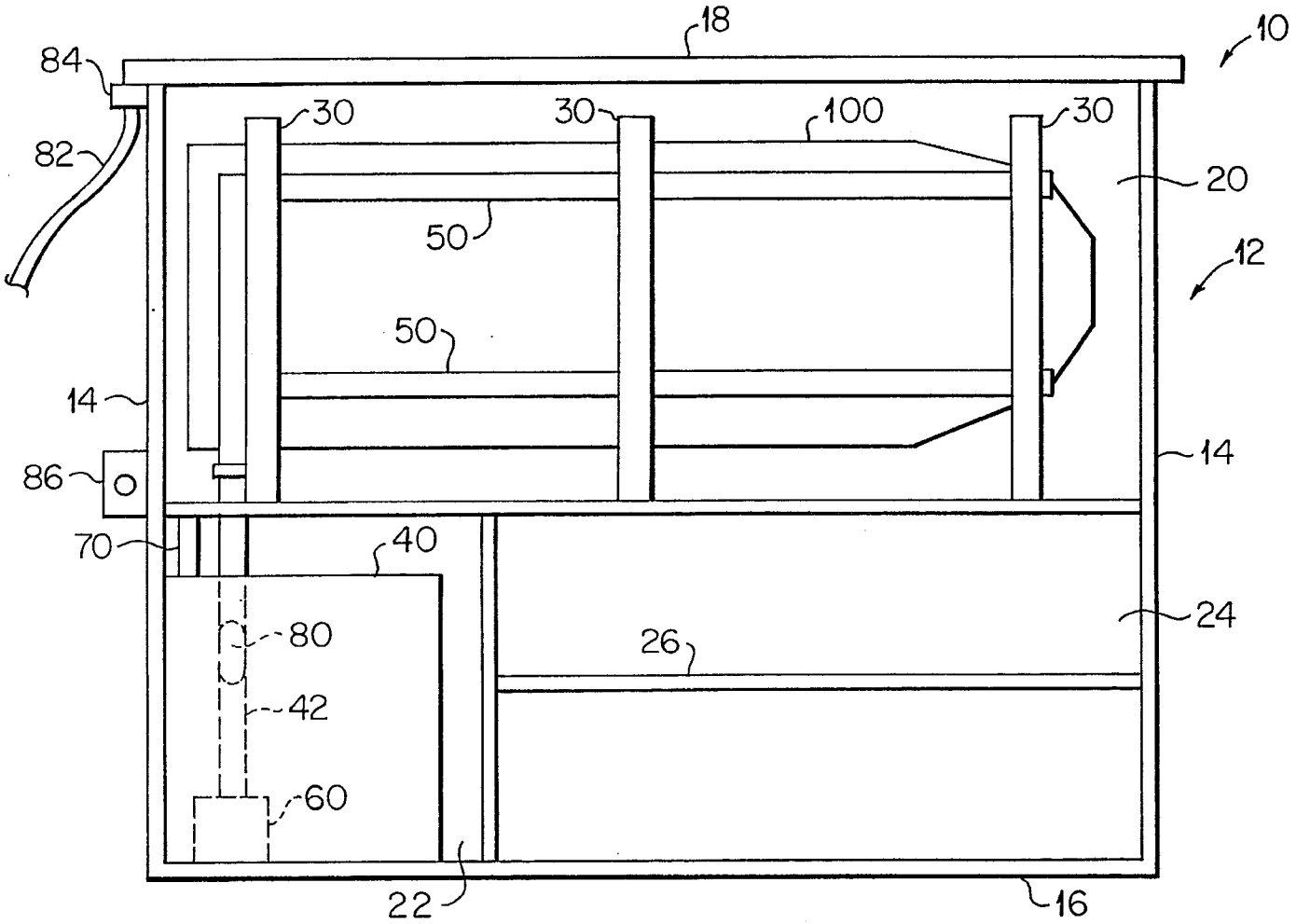
FIG. 1 is a front elevation view of an embodiment of the spineboard decontamination unit of the present invention.

Reference will now be made in detail to the present preferred embodiments of the invention, examples of which are illustrated in the accompanying drawings. Wherever possible, the same reference characters will be used throughout the drawings to refer to the same or like parts.

Figure 2:
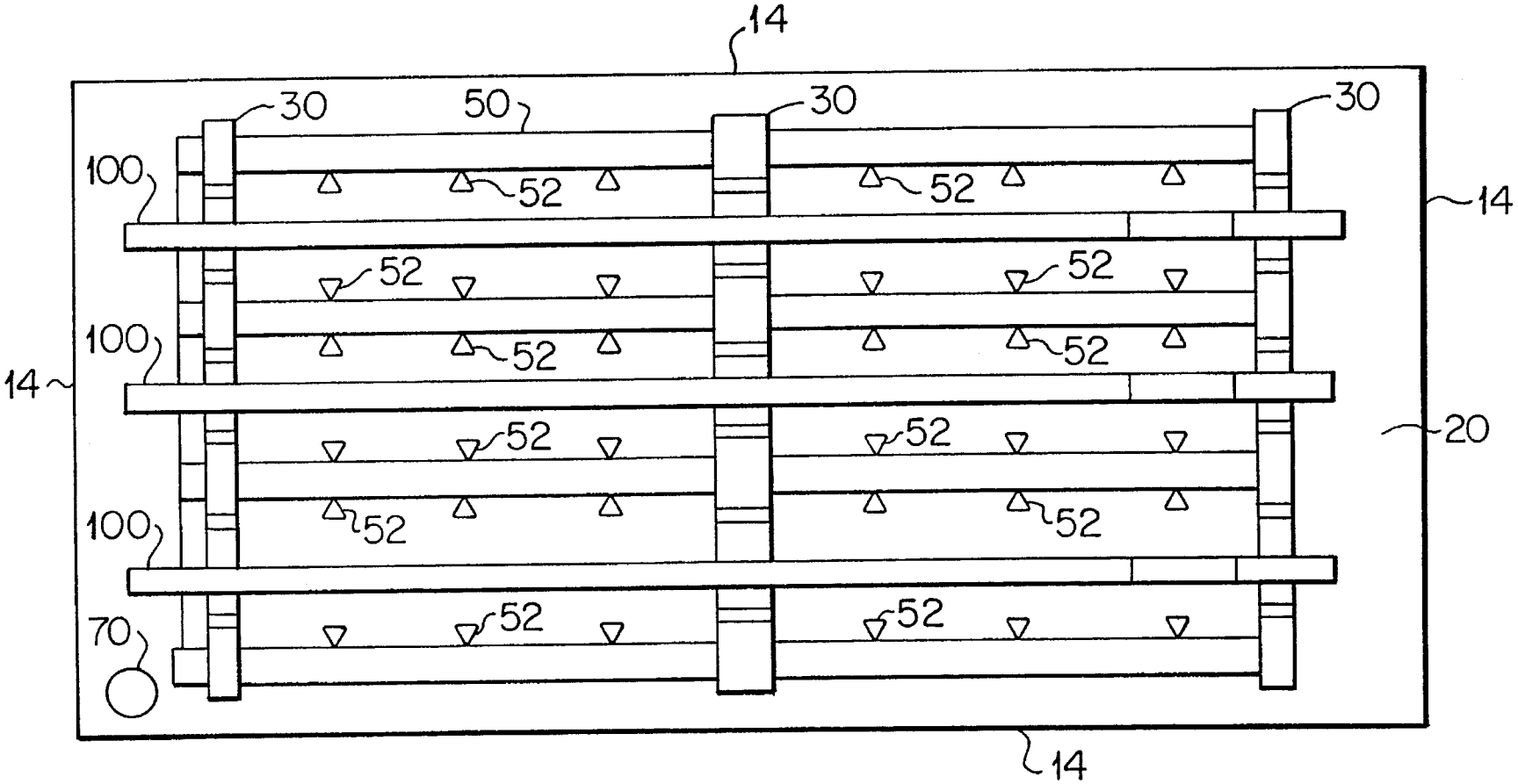
FIG. 2 is a plan view of the spineboard decontamination unit shown in FIG. 1.

As shown in FIGS. 1 and 2, a spineboard decontamination unit 10 of the present invention includes a housing 12 that includes four generally rectangular side walls 14 (the front wall is not shown in FIG. 1 in order to illustrate the components within the housing), a bottom wall 16, and a lid 18 hinged to one of the side walls. The housing is divided into an upper cleaning compartment 20 and a lower compartment 22. Upper compartment 20 provides a watertight enclosure for cleaning the spineboards, while lower compartment 22 stores a tank 40 and other components, discussed later in greater detail, for circulating a cleaning and disinfecting fluid (disinfectant) into upper compartment 20. Lower compartment 22 may be further subdivided to include a storage area 24 with an optional shelf 26. A latchable door (not shown) enclosing lower compartment 22 is preferably included to provide access to tank 40, storage area 24, and other associated components.

The housing may be made of a variety of materials, including aluminum, stainless steel, or plastic. In addition, lid 18 is preferably hinged to a wall of housing 12 with a gas shock absorber to cushion the impact of lid 18 against housing 12 when lid 18 is closed.

The dimensions of housing 12 are dependent on the size and number of spineboards to be cleaned. For a unit capable of holding up to three spineboards, housing 12 may have an upper compartment having a height of twenty inches, a width of fourteen inches (twenty-four inches for a five-board unit), and a length of seventy-four inches. The lower compartment has a height of twenty-four inches, a width (at the base) of twenty-four inches, and a length of seventy-four inches.

In accordance with the invention, there is also provided means for supporting at least one spineboard within the housing. As embodied herein, and as shown in FIGS. 1 and 2, three racks 30 are positioned in upper compartment 20 to support the middle and ends of each spineboard 100. As explained below, in the preferred embodiments these racks also support piping that carry disinfectant for application to the spineboards. Although three racks are shown, any number of racks sufficient to support the spineboards may be used. The racks may also be attached to a base (not shown) to form a unitary structure for easy removal of all of the racks from the upper compartment.

Figure 3:
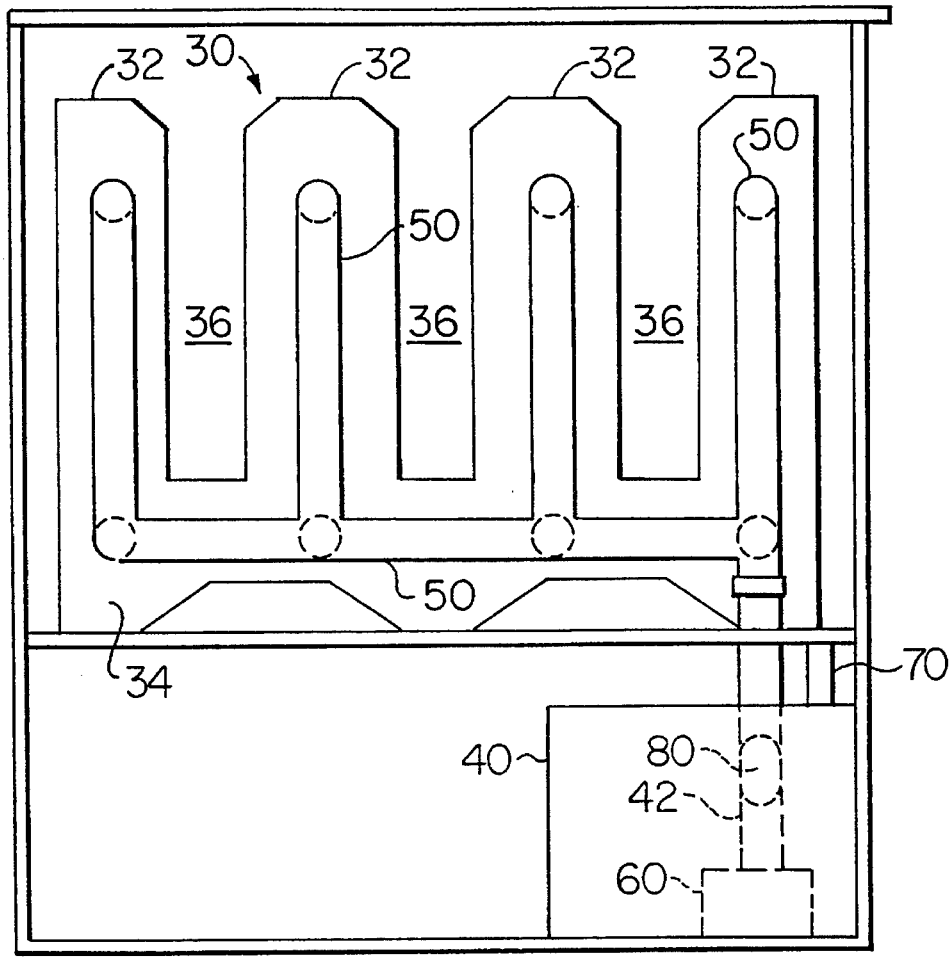
FIG. 3 is a left side view of the spineboard decontamination unit shown in FIG. 1.
Figure 4:
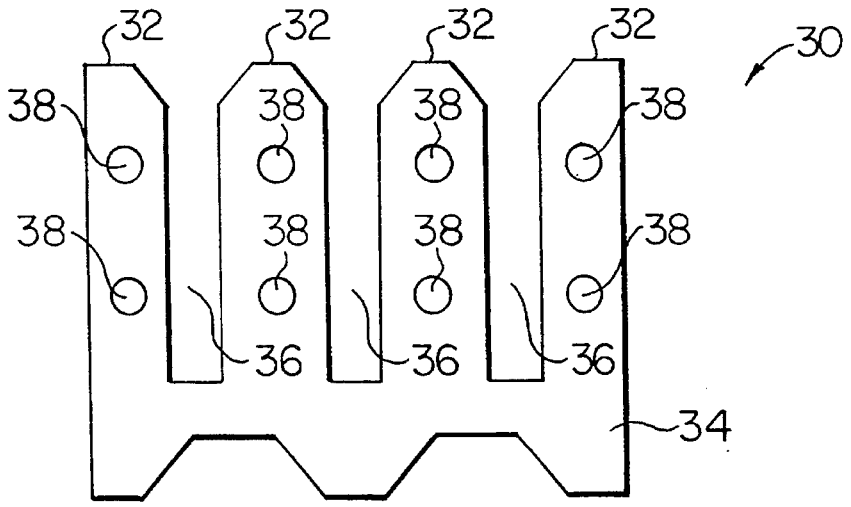
FIG. 4 is a side view of a spineboard rack for use in the spineboard decontamination unit shown in FIG. 1.

As shown in FIGS. 3 and 4, each rack 30 includes four vertical pillars 32 extending from a generally horizontal base 34. The pillars 32 are preferably equally spaced from each other to define three slots 36 of equal dimension for receiving and supporting the spineboards. As shown, the racks can support up to three spineboards, although the configuration of the racks can be varied to have any number of slots as desired.

Each pillar 32 of the rack, as shown in FIG. 4, includes openings 38 for receiving and supporting piping 50 proximate to slots 36. As shown in FIG. 2, impinging means, such as nozzles 52, are attached to piping 50 and are positioned by racks 30 so that nozzles 52 impinge disinfectant against the surfaces of the spineboards. Since piping 50 is not held within the slots 36, contact between the piping 50 and the spineboards is avoided, thereby minimizing potential damage to the piping and nozzles. Piping 50 may be made of several materials, including polyvinyl chloride (PVC).

Nozzles 52 are preferably positioned at different angles relative to piping 50 to impinge the disinfectant against the entire surface of each spineboard. Nozzles 52 may be fixed or adjustable to allow for different angles of impingement.

Tank 40 contains disinfectant and is flow connected to nozzles 52 via piping 50. Tank 40 may be detachably secured or permanently affixed in the lower compartment 22. In a preferred embodiment, the tank has a capacity of twenty gallons, although any capacity may be used. Larger capacities may be desired if recirculation of disinfectant, discussed later, is not desired.

The disinfectant may be a phenolic germicidal detergent, a bleach, or any agent compatible with Occupational Safety and Health Administration (OSHA) standards. For example, a 10% phenolic germicide solution may be employed.

In accordance with the invention, there is also provided a pump for circulating disinfectant from the tank to the nozzles to impinge disinfectant against the spineboards. As embodied herein, and as shown in FIGS. 1 and 3, a pump 60 is coupled to piping 50 with a hose 42, preferably made of VITON™ or polypropylene. Pump 60 may be submersible, as shown in FIGS. 1 and 3, or may be positioned outside of tank 40 so long as the pump provides a sufficient flow rate and pressure, e.g., 8.5 gal./min. and 95 psi, respectively, to effectively clean and disinfect the spineboards.

As previously stated, the present invention may provide for recirculation of the disinfectant after impingement to increase the efficiency of the system. In order to effect recirculation, a drain 70 is formed in the upper compartment 20 and directs used disinfectant back into tank 40. As a result, the disinfectant can be recycled through the piping and nozzles until it reaches its contamination level, which, for a 10% phenolic germicide solution, is about one year. At that time, the disinfectant is replaced. A filter 80 is positioned in the hose 42 upstream of the pump to remove contaminants and other particles from the disinfectant. The filtration media and support materials for the filter are preferably composed of polypropylene.

As shown in FIG. 1, a power cord 82 connects the electronic circuitry (not shown) for controlling the pump to an AC power source. A safety switch 84 is adjacent to the lid 18 and interrupts power to the decontamination unit when the lid is opened.

A timer 86 is preferably incorporated into the electronic circuitry to control the power supply to the pump, thus allowing a user to select a desired cleaning and disinfecting cycle. The timer preferably provides cleaning and disinfecting cycles from ten to thirty minutes.

To disinfect the spineboards, lid 18 of the housing is opened and the spineboards are positioned in slots 36 of racks 30. Lid 18 is then closed and the user selects the desired cleaning cycle with the timer. As a result, pump 60 is activated and circulates disinfectant through piping 50 and nozzles 52 to clean the spineboards until the cycle is completed. The disinfectant impinged against the spineboards is directed back into the tank 40 through drain 70 and is recycled.

Figure 5:
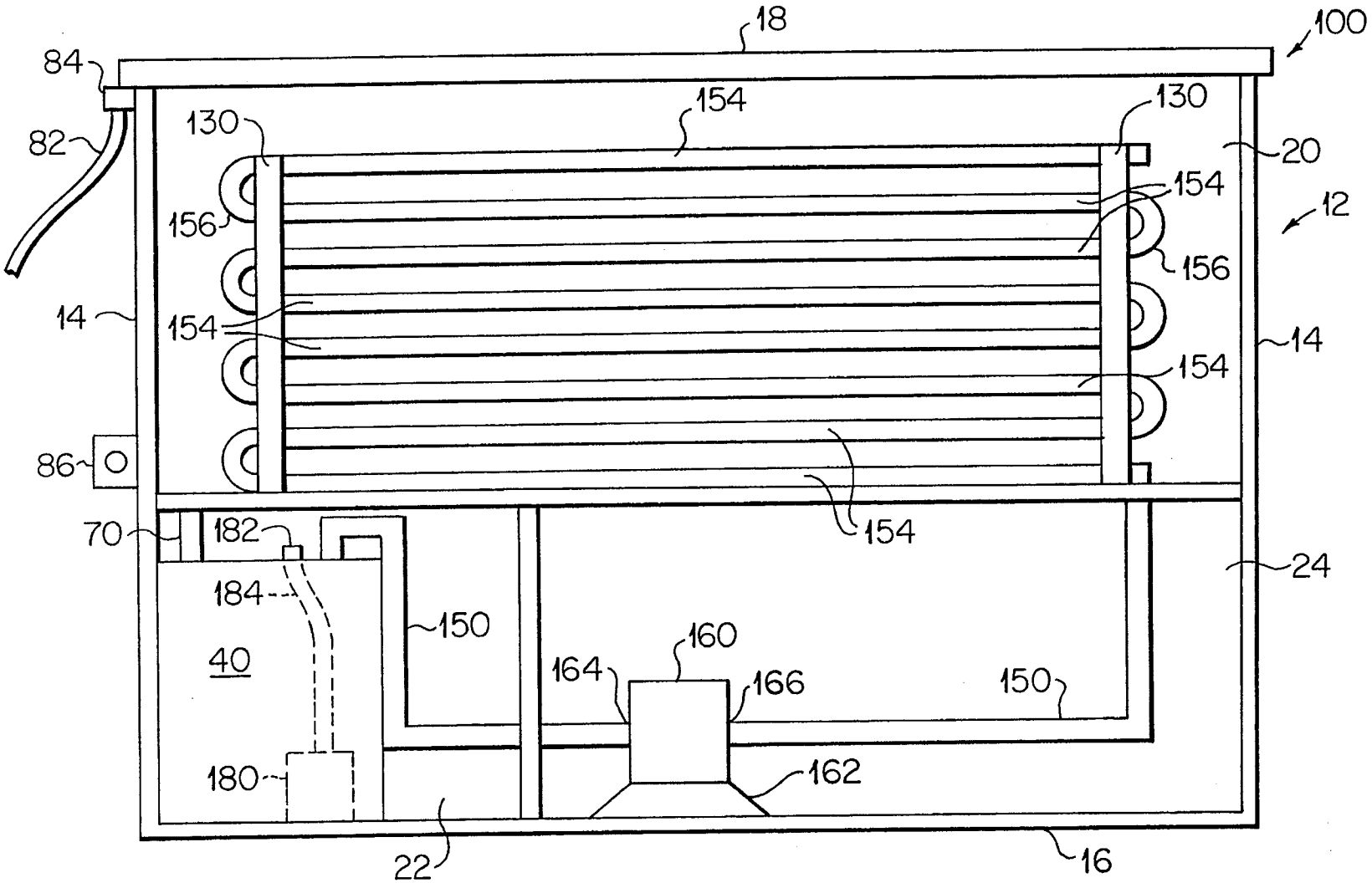
FIG. 5 is a front elevation view of another embodiment of the spineboard decontamination unit.
Figure 6:
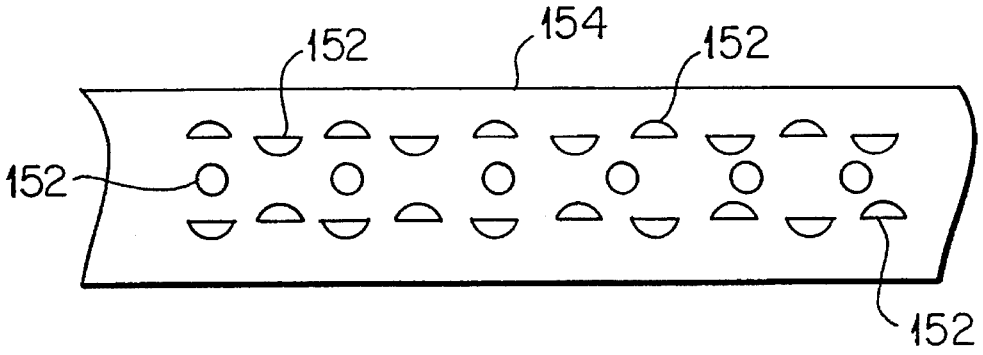
FIG. 6 is a partial front view of a portion of piping in the spineboard decontamination unit shown in FIG. 5.
Figure 7:
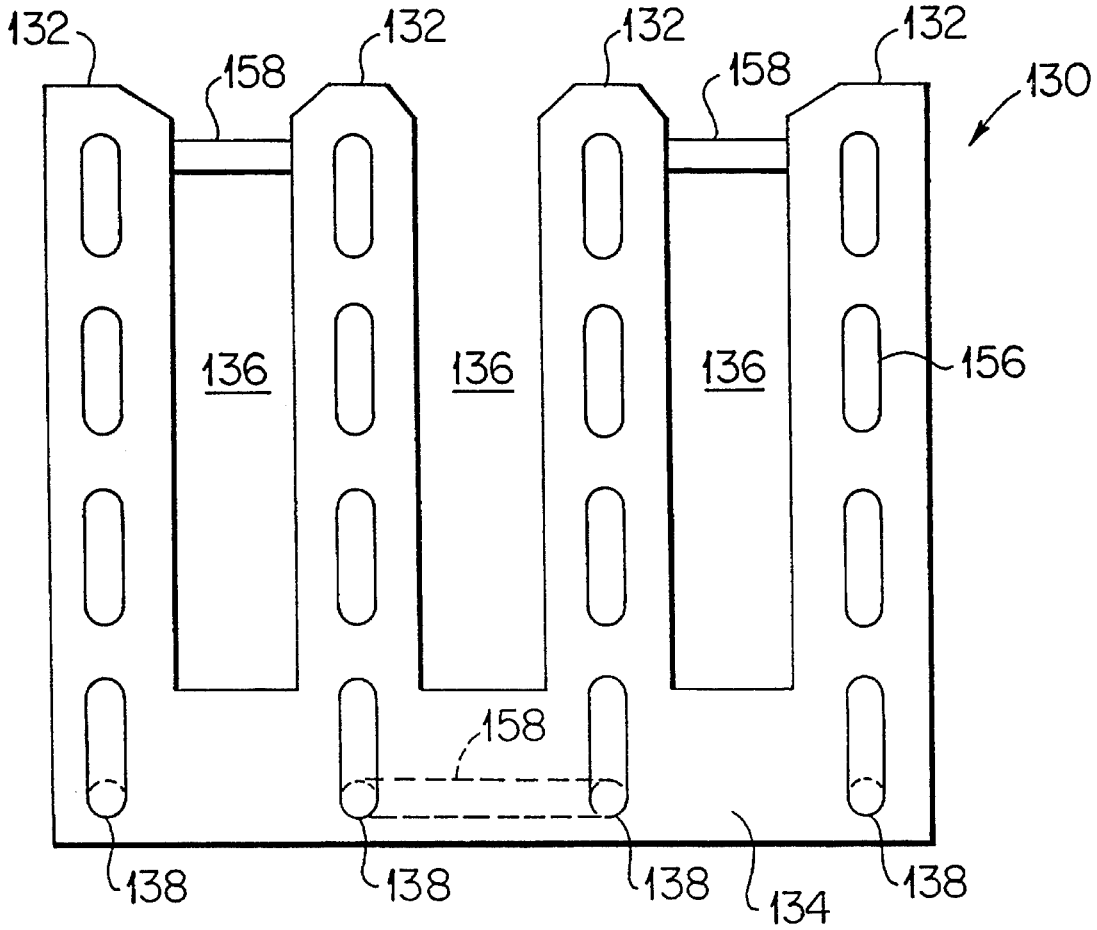
FIG. 7 is a left side view of a rack supporting piping in the spineboard decontamination unit shown in FIG. 5.

Another embodiment is illustrated in FIGS. 5–7 and contains several of the features of the first embodiment. One point of departure, however, is that spineboard decontamination unit 100 includes two racks 130, rather than three racks, for supporting the ends of each spineboard. Each rack 130 includes four vertical pillars 132 extending from a base 134 to define three slots 136 for receiving and supporting ends of the spineboards.

Racks 130 include openings 138 for receiving eight straight segments 154 of piping 150. Piping 150 is preferably composed of a flexible material, such as coiled copper tubing, that allows for a single piece of piping to be fed through each opening 138 in each of the vertical pillars 132, thus providing for thirty-two straight segments 154 of piping. One end of piping 150 is flow connected to an outlet 166 of a pump 160, while the opposite end of piping 150 is capped.

As shown in FIGS. 5 and 7, piping 150 enters upper cleaning compartment 20 and is fed through one of the openings 138 proximate to the bottom of one of the pillars 132. The piping is then fed to the opposite rack 130 to form the lowest straight segment 154. A bent segment 156 in piping 150 connects the lowest straight segment to the next highest straight segment. Piping 150 is then fed in alternating fashion through each of the openings 138 until reaching the top of one of the pillars 132. The piping is then connected to the next pillar 132 via a horizontal bent segment 158 and is fed through the remaining openings of each pillar in a similar fashion.

As shown in FIG. 6, each straight segment 154 includes impinging means, including a plurality of ports 152, for directing disinfectant against the spineboards. The ports can encompass many shapes, including circular, semi-circular, or elliptical, that are sufficient to direct disinfectant against the spineboards. Positioning ports 152 around the circumference of piping 150 also allows for various angles of impingement of disinfectant against the spineboard, thus providing a thorough cleaning of the spineboards.

Another point of departure is that a pump 160 is positioned in storage area 24 with frame 162, rather than being submerged in tank 40. A segment of piping 150 flow connects tank 40 to an inlet 164 of pump 160, while an outlet 166 of pump 160 is flow connected to ports 152 via piping 150. Many types of pumps can be used, and an example of a pump that has been found to be practical is a Teel model No. 2P-372 pump, which provides a flow rate of about 8.5 gal./min. at a pressure of about 95 psi.

Additional features may be added to each embodiment of the spineboard decontamination unit. For example, the unit may include a blower for drying the spineboards after cleaning. The unit may also include a heater for heating the disinfectant before it is impinged against the spineboards. In addition, to facilitate emptying of tank 40, a second pump 180 may be submersed in tank 40 and connected to a port 182 on tank 40 with tubing 184. A user may then empty tank 40 by activating second pump 180 so that disinfectant exits via port 182.

As previously described, the spineboard decontamination unit of the present invention may include a closed-loop circulation system where disinfectant is circulated from the tank through the piping and is impinged against the spineboards, and is then directed back into the tank for recirculation. However, if recirculation is not desired, a second tank (not shown) may be included to collect and store disinfectant impinged against the spineboards. In this instance, drain 70 directs the used disinfectant into the second tank rather than tank 40. Of course, tank 40 will have to be refilled and the second tank emptied when all of the disinfectant has been emptied from tank 40.

It will be apparent to those skilled in the art that various modifications and variations can be made in the apparatus and method of the present invention without departing from the scope or spirit of the invention. For example, the piping and nozzles or ports can be attached to the walls of the upper compartment and still effect cleaning and disinfecting of the spineboards. Thus, it is intended that the present invention cover the modifications and variations of this invention provided they come within the scope of the claims and their equivalents.

What is claimed is:

1. Apparatus for cleaning and disinfecting spineboards with a disinfectant, comprising:

a housing;

at least one rack for supporting at least one spineboard within the housing;

a tank for containing the disinfectant;

piping positioned in the housing and in flow communication with the tank, the piping including means for impinging the disinfectant against the at least one spineboard; and a pump for circulating the disinfectant from the tank through the piping and impinging means, the pump and the impinging means being sized to impinge the disinfectant against the at least one spineboard with sufficient force and flow to clean and disinfect the entire surface of the spineboard.

2. The apparatus of claim 1, further comprising a drain in the housing for directing the disinfectant impinged against the at least one spineboard back into the tank.

3. The apparatus of claim 1, further comprising a filter upstream of the pump for removing contaminants from the disinfectant.

4. The apparatus of claim 1, further comprising means for controlling the pump to selectively circulate the disinfectant through the piping.

5. The apparatus of claim 1, including a plurality of racks for supporting ends of the least one spineboard, the racks also supporting the impinging means of the piping proximate to the at least one spineboard.

6. The apparatus of claim 5, wherein the racks each include a plurality of pillars extending from a base to define a plurality of slots therebetween for receiving and supporting a plurality of spineboards.

7. The apparatus of claim 6, wherein the pillars of the racks each include openings for receiving the piping.

8. The apparatus of claim 1, further comprising a second pump, submersible in the tank, for emptying the disinfectant from the tank when the disinfectant is to be replaced.

9. The apparatus of claim 1, wherein the disinfectant is one of a phenolic germicidal detergent and a bleach.

10. The apparatus of claim 1, wherein the impinging means includes at least one of a plurality of nozzles attached to the piping and a plurality of ports in the piping.

11. Apparatus for cleaning and disinfecting articles with a disinfectant, comprising:

a housing;

a support in the housing for supporting a plurality of articles, the support including at least two sections each having a plurality of parallel pillars extending from a base to define a plurality of adjacent slots for receiving and supporting at least a portion of the articles;

a tank for containing the disinfectant;

piping in flow communication with the tank, the piping supported by the pillars of the support and proximate to the plurality of slots, the piping including means for impinging the disinfectant against the articles; and a pump for circulating the disinfectant from the tank through the piping and impinging means, the pump and the impinging means being sized to impinge the disinfectant against the articles with sufficient force and flow to clean and disinfect the entire surface of each of the articles.

12. The apparatus of claim 11, wherein the articles are spineboards.

13. The apparatus of claim 11, further comprising a drain in the housing for directing the disinfectant impinged against the articles back into the tank.

14. Apparatus for cleaning and disinfecting spineboards with a disinfectant, comprising:

a housing having a watertight enclosure;

means for supporting at least one spineboard within the watertight enclosure;

a tank for containing the disinfectant;

piping supported within the watertight enclosure and in flow communication with the tank, the piping including a plurality of ports;

a pump for circulating the disinfectant from the tank to the piping and ports, the pump and the ports being sized to impinge the disinfectant against the at least one spineboard with sufficient force and flow to clean and disinfect the entire surface of each spineboard; and a drain in the watertight enclosure for collecting the disinfectant impinged against the at least one spineboard and directing the disinfectant back into the tank.

15. The apparatus of claim 14, wherein the ports are disposed around the periphery of the piping to provide for different angles of impingement of the disinfectant against the at least one spineboard.

16. The apparatus of claim 14, wherein the piping comprises a single length of flexible copper tubing having one connected to the pump and an opposite end that is capped.

* * * * *